US006520809B1

(12) United States Patent
Son

(10) Patent No.: US 6,520,809 B1
(45) Date of Patent: Feb. 18, 2003

(54) POWER PINS IN HARD DISK DRIVE

(75) Inventor: Byung-Kug Son, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/146,943

(22) Filed: Sep. 3, 1998

(30) Foreign Application Priority Data

Sep. 3, 1997 (KR) ..... 97/45611

(51) Int. Cl.[7] ..... H01R 13/64

(52) U.S. Cl. ..... 439/679; 439/101; 439/76.1; 439/924.1

(58) Field of Search ..... 439/101, 924.1, 439/679, 677, 678, 79, 76.1

(56) References Cited

U.S. PATENT DOCUMENTS

| | | | | | |
|---|---|---|---|---|---|
| 3,432,795 | A | | 3/1969 | Jayne | |
| 4,146,291 | A | * | 3/1979 | Goff et al. | 439/924.1 |
| 4,746,298 | A | * | 5/1988 | Hollander | 439/222 |
| 4,867,690 | A | * | 9/1989 | Thumma | 439/79 |
| 4,889,495 | A | * | 12/1989 | Kimura | 439/924.1 |
| 4,908,715 | A | * | 3/1990 | Krum et al. | 361/685 |
| 4,927,382 | A | * | 5/1990 | Huber | 439/924.1 |
| 4,975,067 | A | * | 12/1990 | Bastijanic et al. | 439/924.1 |
| 4,975,085 | A | * | 12/1990 | Cartesse et al. | 439/924.1 |
| 4,985,870 | A | | 1/1991 | Faraci | |
| 5,197,887 | A | | 3/1993 | Davidge et al. | |
| 5,268,592 | A | * | 12/1993 | Bellamy et al. | 439/924.1 |
| 5,277,591 | A | | 1/1994 | Felcman et al. | |
| 5,346,406 | A | * | 9/1994 | Hoffman et al. | 439/924.1 |
| 5,384,492 | A | * | 1/1995 | Carlson et al. | 439/924.1 |
| 5,508,860 | A | | 4/1996 | Takagi et al. | |
| 5,538,436 | A | * | 7/1996 | Garney | 439/924.1 |
| 5,541,787 | A | | 7/1996 | Jabbari et al. | |
| 5,742,844 | A | | 4/1998 | Feldman | |

FOREIGN PATENT DOCUMENTS

| | | | | |
|---|---|---|---|---|
| GB | 645795 | * | 11/1950 | 439/679 |
| GB | 1023038 | * | 3/1966 | 439/679 |
| JP | 189873 | * | 7/1990 | 439/679 |

* cited by examiner

*Primary Examiner*—Gary Paumen
*Assistant Examiner*—Felix O. Figueroa
(74) *Attorney, Agent, or Firm*—Robert E. Bushnell, Esq.

(57) ABSTRACT

Power pins of a hard disk drive include two exposed power supply pins and two exposed ground pins. The length of the power supply pins is different from (preferably, larger than) that of the ground pins. The diameter of the power supply pins is different from (preferably, smaller than) that of the ground pins.

8 Claims, 3 Drawing Sheets

POWER PINS IN HARD DISK DRIVE

CLAIM OF PRIORITY

This application makes reference to, incorporates the same herein, and claims all benefits accruing under 35 U.S.C. §119 from an application for POWER PINS IN HARD DISK DRIVE earlier filed in the Korean Industrial Property Office on Sep. 3, 1997 and there duly assigned Ser. No. 45611/1997.

BACKGROUND OF THE INVENTION

1. Field of the Invention

The present invention relates to a hard disk drive and, in particular, to power pins of a hard disk drive to be inserted into a power connector connected to a power supply.

2. Related Art

A hard disk drive is generally a significant component for a computer in its role as an auxiliary storage device. In the current multimedia environment, the hard disk drive (HDD) inevitably undergoes developmental work directed toward high-density recording, and thus high capacity capability. Hence, competition is substantial in the hard disk drive field to obtain an advantageous position for the high-capacity hard disk drive through technological innovation as well as development of new heads and media.

The hard disk drive is a mechatronics product composed of electronic and mechanical devices, and it is one of the auxiliary storage devices for recording a digital signal on and reproducing a digital signal from a magnetizable disk by means of a head acting as an electromagnet.

Typically, a hard disk drive installed in a PC (Personal Computer) body includes power pins and signal pins which are exposed for connection to a main board of the body. Unfortunately, there is a tendency, when assembling the hard disk drive in the PC, to incorrectly insert the power connector onto the power pins of the hard drive. For example, the power connector can be inadvertently slanted when inserting it onto the power pins, and a short circuit connection between the power pins and the ground pins can result. This can cause damage to the integrated circuits (ICs) on the main board, and even to the main board itself.

The following patents are considered to be representative of the prior art, and are burdened by the disadvantages set forth herein: U.S. Pat. No. 3,432,795 to Jayne, entitled Electrical Connector Having Facile Engagement Means, U.S. Pat. No. 4,985,870 to Faraci, entitled Apparatus For Connecting electronic Modules Containing Integrated Circuits And Backup Batteries, U.S. Pat. No. 5,197,887 to Davidge et al., entitled High Density Circuit Connector, U.S. Pat. No. 5,277,591 to Felcman et al., entitled Extended Card Edge Connector And Socket, U.S. Pat. No. 5,508,860 to Takagi et al., entitled Disk Drive Design Having Reduced Height And Improved Means For Electrical Connections, U.S. Pat. No. 5,541,787 to Jabbari et al., entitled Head Disc Assembly With Printed Circuit Cable Connector Adapted For Automated Assembly, and U.S. Pat. No. 5,742,844 to Feldman, entitled IBM PC Compatible Multi-Chip Module.

Some of these patents (for example, Jayne '795 and Jabbari '787) disclose electrical connectors having pins of varying lengths. None of the above patents discloses an electrical connector having pins of varying diameter. Moreover, none of the patents addresses the problem of inadvertent poor connection of a connector to power pins and ground pins of the hard disk drive, as described above.

Therefore, there is a need for the development of a hard disk drive having power pins which are of different lengths and/or diameters, and more particularly there is a need for the development of a hard disk drive having a capability of preventing incorrect or improper insertion of a power connector onto the power pins of the hard disk drive.

SUMMARY OF THE INVENTION

To solve the above problem, an object of the present invention is to provide a hard disk drive having power pins which are of different lengths.

Furthermore, it is another object of the present invention to provide a hard disk drive having power pins which are of different diameters.

Another object of the present invention is to provide a hard disk drive having power pins in which incorrect insertion-induced short circuits therebetween are prevented.

To achieve the above objects, there is provided a hard disk drive having power pins which include two exposed power supply pins and two exposed ground pins, the length of the power supply pins being different from that of the ground pins.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
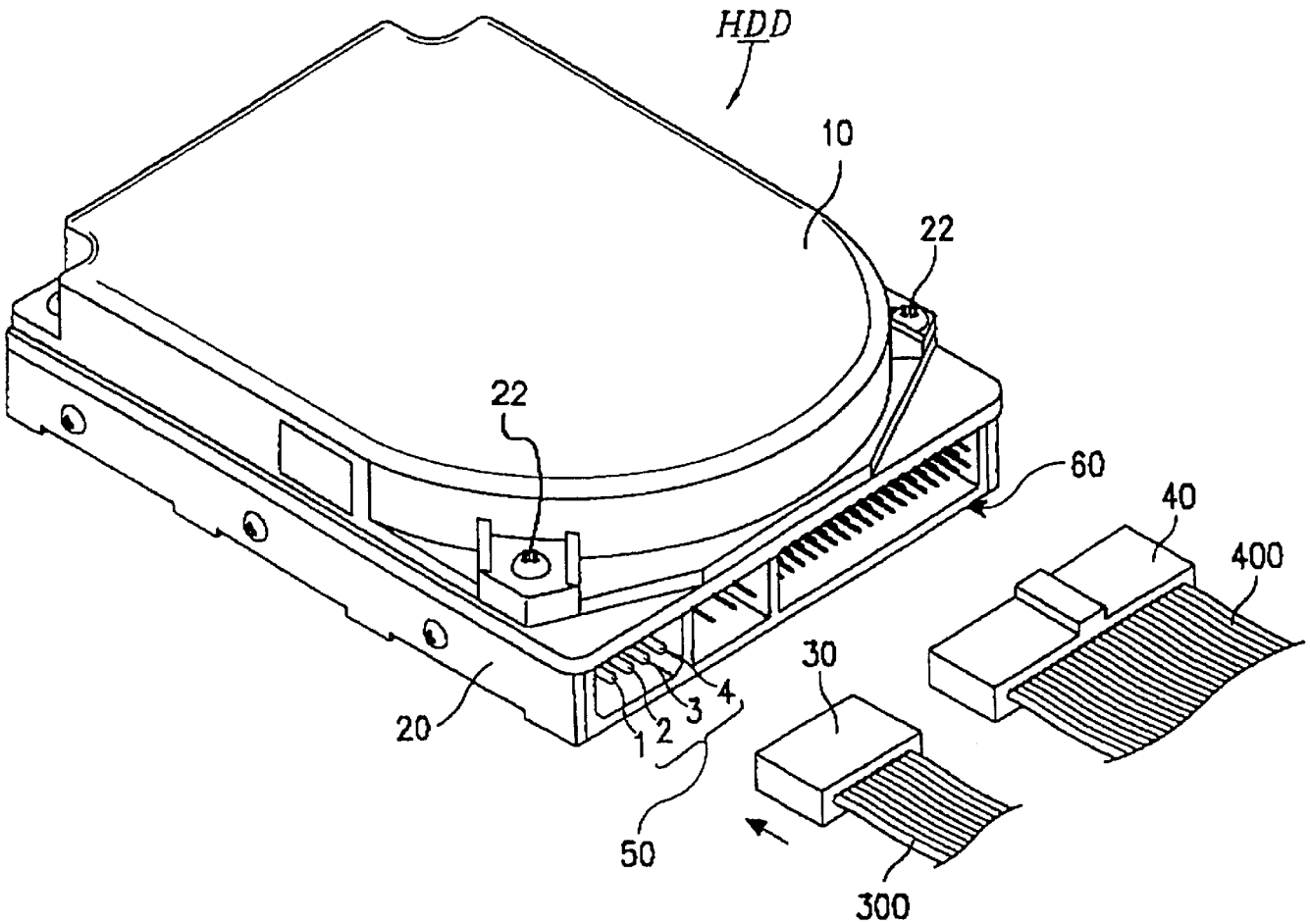
FIG. 1 (PRIOR ART)
FIG. 1 is a perspective view of a hard disk drive.

A preferred embodiment of the present invention will be described in detail with reference to the attached drawings. As will be readily appreciated, like reference numerals denote the same components in the drawings, and a detailed description of related known function and structure of the present invention is avoided if it is deemed to obscure the subject matter of the present invention.

A hard disk drive is illustrated in FIG. 1. As shown in FIG. 1, a hard disk drive HDD is assembled, just before it comes onto the market with a base 10 and a cover 20 by screws 22. The hard disk drive HDD is sealed by vertically engaging the screws 22 on the corners thereof. To install the assembled hard disk drive in a PC (Personal Computer) body, power pins 50 are exposed at a portion of the hard disk drive, for connection with a power supply of the body, and signal pins 60 are exposed at another portion thereof, for connection with a main board of the body. The numbers of power pins 50 and signal pins 60 are four and forty, respectively. The numbers can be changed depending on interface type. The power pins 50 are inserted into a power connector 30 connected to a power cable 300 which is, in turn, connected to a power supply, and the signal pins 60 are inserted into a PC cable connector 40 connected to a PC cable 400 which is, in turn, connected to a main board. As will be easily understood, the hard disk drive is connected to the main board and to the power supply by these connectors. This connection structure is also applied to connect a CD-ROM (Compact Disk-Read Only Memory) drive to the body.

In the above structure, power pins 1 and 4 among the power pins 50 are used to supply 5V and 12V, respectively, and power pins 2 and 3 are ground pins used as a ground-1 and a ground-2, respectively. The power pin 1 supplies a power supply voltage to devices and ICs on the main board, and the power pin 4 supplies a power supply voltage for driving a spindle motor. However, when a power supply voltage is to be supplied from the PC body or a power supply, incorrect insertion or even slightly slanted insertion of the power connector onto the power pins may cause a short circuit between the 5V power pin and the ground-1 power pin and a short circuit between the 12V power pin and the ground-2 power pin, thereby damaging ICs on the main board of the body and the main board itself at worst. This is because the exposed power pins are all of the same length and diameter.

Figure 2:
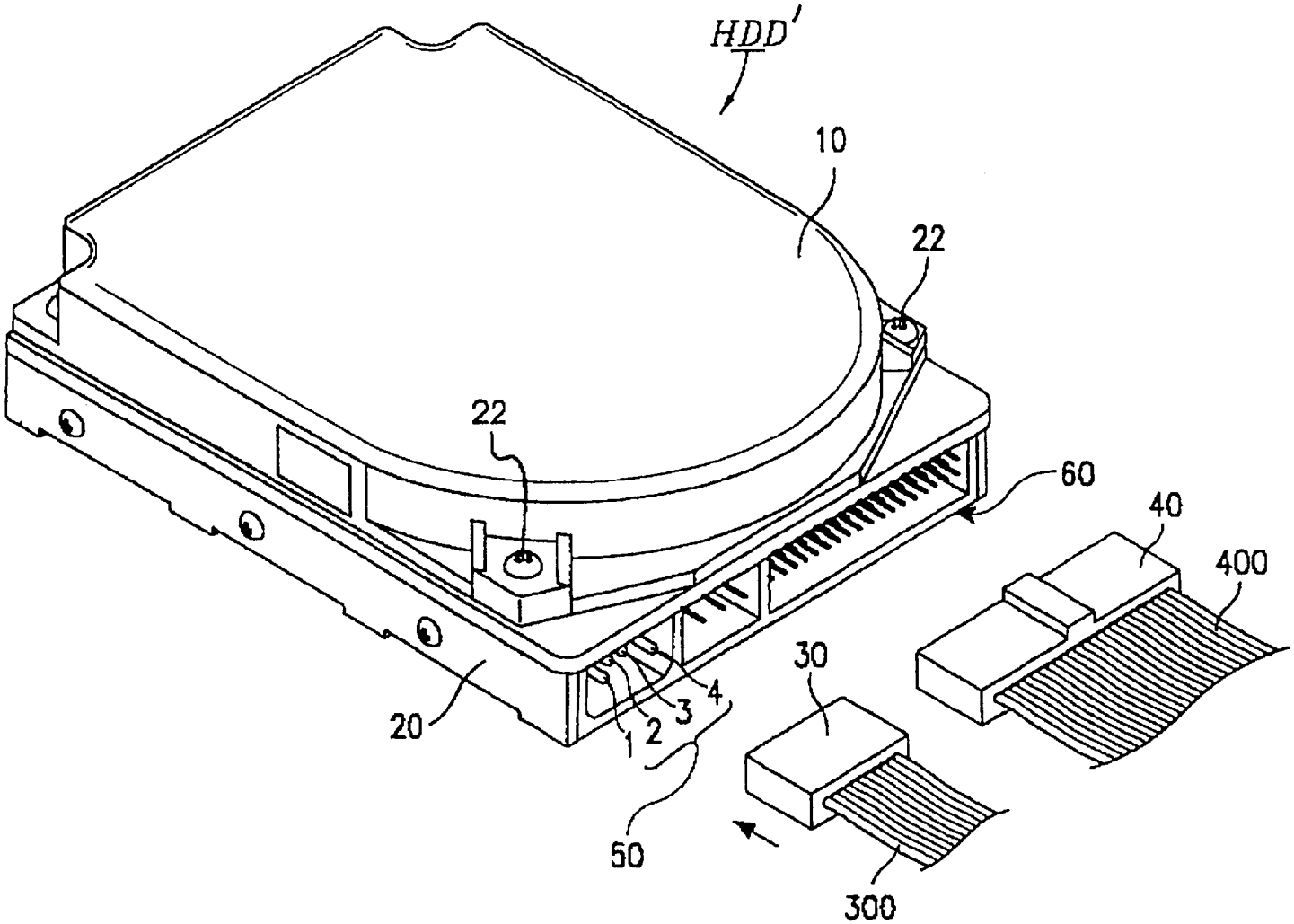
FIG. 2 is a perspective view of a hard disk drive according to a preferred embodiment of the present invention.

FIG. 2 is a perspective view of a hard disk drive according to a preferred embodiment of the present invention.

In FIG. 2, a hard disk drive HDD' is assembled just before it comes onto the market with the base 10 and the cover 20 by the screws 22. The hard disk drive HDD' is sealed by vertically engaging the screws 22 on the corners thereof. To install the assembled hard disk drive in a PC body, the power pins 50 are exposed at a portion of the hard disk drive for connection with a power supply in the body, and the signal pins 60 are exposed at another portion thereof for connection with a main board of the body. The numbers of power pins 50 and signal pins 60 are four and forty, respectively. The numbers can be changed depending on interface type. The power pins 50 are inserted into the power connector 30 connected to a power cable 300 which is, in turn, connected to a power supply, and the signal pins 60 are inserted into the PC cable connector 40 connected to the PC cable 400 which is, in turn, connected to the main board. As will be easily understood, the hard disk drive is connected to the main board and to the power supply by these connectors. This connection structure is also applied to connect a CD-ROM drive to a body.

In the above structure, the power pins 1 and 4 among the power pins 50 are used to supply 5V and 12V, respectively, and the power pins 2 and 3 are ground pins used as ground-1 and ground-2, respectively. The power pin 1 supplies a power supply voltage to devices and ICs on the main board, and the power pin 4 supplies a power supply voltage for driving a spindle motor. The length of the power supply pins 1 and 4 is different from that of the ground pins 2 and 3. In FIG. 2, the power pins 1 and 4 are longer than the ground pins 2 and 3.

Figure 3:
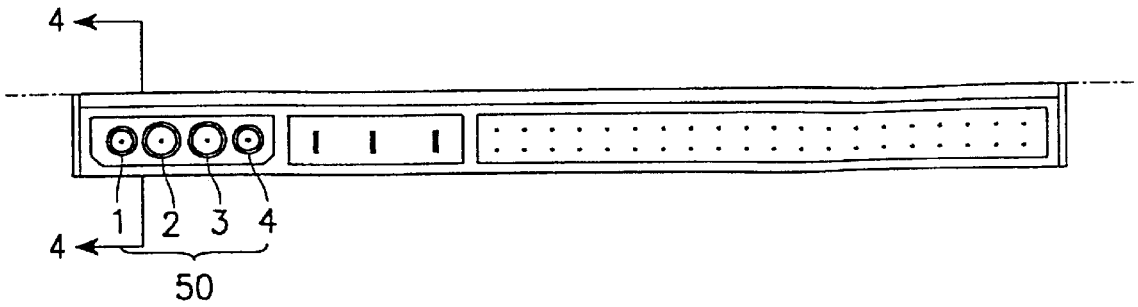
FIG. 3 is a partial frontal view of the hard disk drive shown in FIG. 2.
Figure 4:
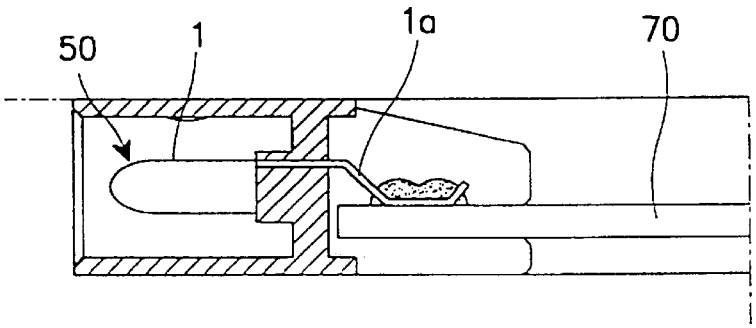
FIG. 4 is a sectional view of the disk taken along line 4—4 shown in FIG. 3.

Referring to FIG. 3, the diameter of the power supply pins 1 and 4 is different from that of the ground pins 2 and 3. That is, in FIG. 3, the power supply pins 1 and 4 are smaller in diameter than the ground pins 2 and 3. By making the power supply pins 1 and 4 different from the ground pins 2 and 3 in length and diameter, a user can conveniently insert the power connector 30 onto the power pins 50. This is because the different lengths of power pins 50 facilitate correct insertion of the power pins, as contrasted with power pins of the same length. Furthermore, the difference in diameter between the power pins 50 also facilitates correct insertion of the power pins 50, prevents misinsertion, and enables tighter connection between the pins 50 and the connector 30. After the power connector 30 is connected to the power pins 50, each power pin 50 is connected to a main board 70 by soldering a terminal 1*a* between pin 50 and the board 70 in the hard disk drive, as shown in FIG. 4. As a result, the power pins of the present invention are correctly inserted into a power connector with ease, thereby preventing damage to devices and ICs of a main board. In addition, short circuit between power pins can be prevented.

While the present invention has been described in detail with reference to the specific embodiment, it is clearly understood that many variations can be made by anyone skilled in the art within the scope and spirit of the present invention.

What is claimed is:

1. In a hard disk drive which includes power supply pins and ground pins;

the improvement wherein said power supply pins are of equal lengths and equal diameters relative to each other, and said ground pins are of equal lengths and equal diameters relative to each other;

wherein said power supply pins and said ground pins are arranged in a row, and wherein said power supply pins are located at respective ends of the row, and said ground pins are located between said power supply pins; and wherein a length of the power supply pins is different from a length of the ground pins.

2. In the hard disk drive of claim 1, wherein the length of said power supply pins is larger than the length of said ground pins.

3. In the hard disk drive of claim 1, wherein a diameter of said power supply pins is smaller than a diameter of said ground pins.

4. In the hard disk drive of claim 1, wherein a diameter of said power supply pins is different from a diameter of said ground pins.

5. In the hard disk drive of claim 4, wherein the diameter of said power supply pins is smaller than the diameter of said ground pins.

6. Power pins in a hard disk drive, comprising:

two exposed power supply pins having equal lengths and equal diameters relative to each other; and two exposed ground pins having equal lengths and equal diameters relative to each other;

wherein a length of said power supply pins is greater than a length of said ground pins, and a diameter of the power supply pins is different from a diameter of the ground pins; and wherein said power supply pins and said ground pins are arranged in a row, and wherein said power supply pins are located at respective ends of the row, and said ground pins are located between said power supply pins.

7. The power pins as claimed in claim 1, wherein the diameter of said power supply pins is smaller than the diameter of said ground pins.

8. In a hard disk drive which includes power supply pins and ground pins;

the improvement wherein said power supply pins are of equal lengths and equal diameters relative to each other, and said ground pins are of equal lengths and equal diameters relative to each other;

wherein said power supply pins have a diameter which is different from a diameter of said ground pins;

wherein said power supply pins and said ground pins are arranged in a row, and wherein said power supply pins are located at respective ends of the row, and said ground pins are located between said power supply pins; and wherein a length of said power supply pins is greater than a length of said ground pins.

* * * * *